United States Patent [19]

Stemen

[11] 4,333,599

[45] Jun. 8, 1982

[54] CRIMPED-ON DRUM COVER HANDLE

[75] Inventor: Michael J. Stemen, Bolingbrook, Ill.

[73] Assignee: The Continental Group, Inc., Stamford, Conn.

[21] Appl. No.: 217,351

[22] Filed: Dec. 17, 1980

[51] Int. Cl.[3] ..... B65D 25/28; B65D 45/16

[52] U.S. Cl. ..... 229/5.7; 16/114 R; 16/126; 220/91; 220/94 R; 220/324; 229/52 A; 292/258

[58] Field of Search ..... 220/91, 94 R, 323, 324, 220/326; 229/5.7, 52 A; 292/256, 258; 16/114 R, 126

[56] References Cited

U.S. PATENT DOCUMENTS

| | | | |
|---|---|---|---|
| 2,129,250 | 9/1938 | Varker | 292/256 |
| 2,153,122 | 4/1939 | Powell | 229/5.7 X |
| 2,796,193 | 6/1957 | Rhodes | 220/91 |

FOREIGN PATENT DOCUMENTS

| | | | |
|---|---|---|---|
| 519095 | 4/1953 | Belgium | 220/91 |
| 6148 | of 1910 | United Kingdom | 220/91 |

*Primary Examiner*—Allan N. Shoap
*Attorney, Agent, or Firm*—Charles E. Brown

[57] ABSTRACT

A hinge member for securing a handle on a drum. The hinge member is in the form of a bent strip of metal which interlocks to a conventional crimped-on cover and, once the cover is applied to the open end of the drum, the hinge member is securely fixed in place. The hinge member includes a receptacle portion which receives both a curl at the lower end of the cover skirt and the pivot shaft of the handle so that the handle, when utilized, is trapped between the curl and a lower portion of the hinge member.

10 Claims, 6 Drawing Figures

CRIMPED-ON DRUM COVER HANDLE

This invention relates in general to new and useful improvements in fibre drums, and more specifically to the mounting of handles on the fibre drum for ease of handling the drum.

Fibre drums of a certain class have open upper ends over which peripheral portions of a cover are telescoped and then crimped to form an interlock. This invention particularly relates to the provision of a hinge member which is interlockable, primarily with the cover, for hingedly mounting a conventional handle.

Most specifically, this invention has to do with the provision of a hinge member which may be loosely interlocked with a conventional cover for a fibre drum and, when the cover is applied to the fibre drum and crimped thereon, the hinge member will be firmly locked in place.

With the above and other objects in view that will hereinafter appear, the nature of the invention will be more clearly understood by reference to the following description, the appended claims, and the several views illustrated in the accompanying drawings.

IN THE DRAWINGS

Figure 1:
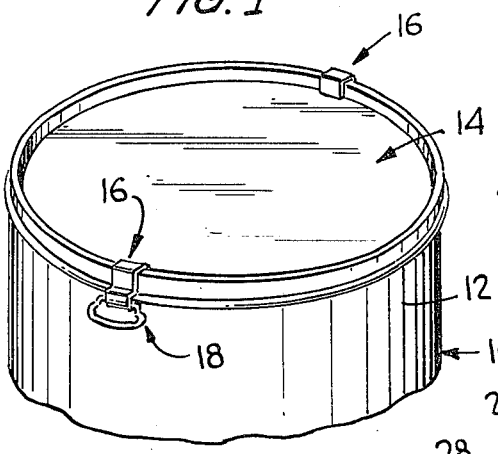
FIG. 1 is a perspective view of the upper portion of a fibre drum provided with handles in accordance with this invention.

Referring now to the drawings in detail, it will be seen that there is illustrated in FIG. 1 the upper portion of a conventional fibre drum 10 which includes a cylindrical body 12 having the open upper end thereof closed by a cover 14. The cover 14 carries a pair of hinge members 16 which, in turn, hingedly mount handles 18.

Figure 2:
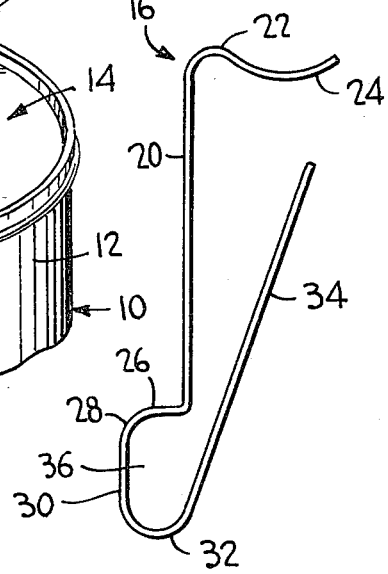
FIG. 2 is an enlarged side elevational view of a hinge member in accordance with the invention.
Figure 3:
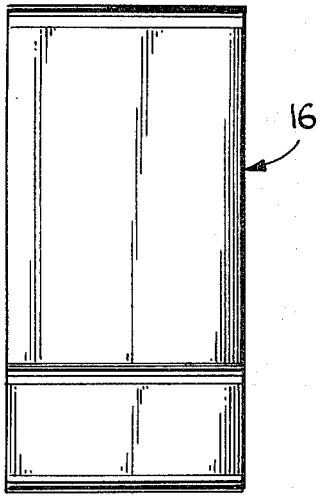
FIG. 3 is an end elevational view of the hinge member of FIG. 2, and shows the strap configuration thereof.

Referring now to FIGS. 2 and 3, it will be seen that the hinge member 16 is formed of a strip or strap of metal and includes an upstanding primary leg 20 which terminates at its upper end in a downwardly opening reversely bent anchor portion 22. The anchor portion 22 has extending therefrom a locking flap 24 which is also of a curved configuration and forms a smooth transition from the anchor portion 22. The locking flap opens upwardly.

At the lower end of the primary leg 20, the hinge member 16 is provided with an offset 26 which includes a downwardly curved portion 28. The portion 28 terminates in a depending leg 30 which, in turn, terminates in a reverse bend 32 which opens upwardly. Finally, an anchor leg 34 extends upwardly and inwardly from the reverse bend 32.

As will become apparent hereinafter, the offset 26, the curved portion 28, the leg 30, the reverse bend 32 and the anchor leg 34 combine to define a receptacle 36.

Figure 4:
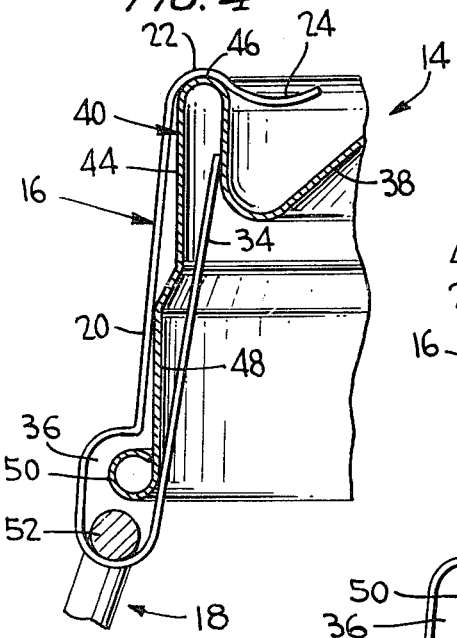
FIG. 4 is a fragmentary sectional view taken through a drum cover, and shows the initial interlocking of the hinge member therewith, including an upper portion of an associated handle.
Figure 5:
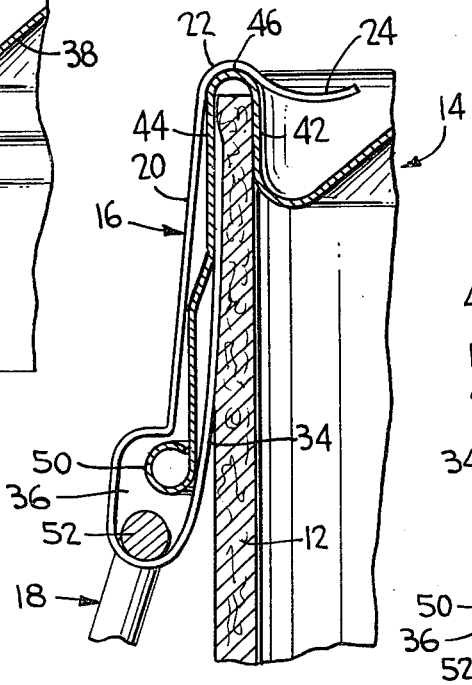
FIG. 5 is a fragmentary sectional view showing the cover, hinge member and handle loosely applied to an upper portion of a drum.
Figure 6:
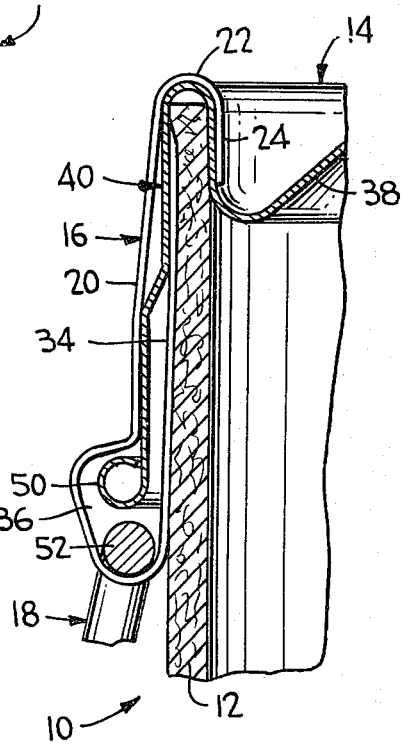
FIG. 6 is another fragmentary sectional view similar to FIG. 5, and shows the cover applied to the drum in final crimped interlocking relation therewith.

Reference is now made to FIGS. 4–6 wherein the general details of the cover 14 are illustrated. The cover 14 includes an end panel 38 which is surrounded by a peripheral portion 40 which includes an inner upstanding wall 42, a depending skirt 44 and a connecting bight 46 which defines an upper rim. The skirt 44 may have a lower outwardly offset portion 48 and the skirt terminates in a lowermost outwardly and upwardly turned curl 50.

As will be readily apparent from FIGS. 5 and 6, the inner wall 42 and the upper part of the skirt 44 are separated in a transverse direction sufficiently for the peripheral portion 40 to be readily telescoped over the upper end of the drum body 12.

Returning once again to FIG. 4, it will be seen that a handle 18 is coupled with the hinge member 16 with the pivot shaft 52 of the handle 18 positioned in the lower portion of the receptacle 36. After the hinge member 16 and the handle 18 are so assembled, the hinge member is assembled on the cover 14 with the anchor leg 34 disposed radially inwardly of the skirt 44 and terminating at its upper end between the inner wall 42 and the upper portion of the skirt 44. The curl 50 of the skirt is positioned within the receptacle 36 above the pivot shaft 52. Finally, the anchor portion 22 is engaged over the rim with the locking flap 24 still extending generally horizontally.

The assembled cover, hinge member and handle are now ready to be assembled with a filled drum for the purpose of closing the open upper end of the drum body 12. To do so the cover 14 is placed on the drum body 12 in the normal manner with the upper end portion of the drum body 12 projecting into the peripheral portion 40 of the cover between the inner wall 42 and the skirt 44. When the cover 14 is firmly seated on the upper end of the drum body, it is crimped in place by crimping together the inner wall 42 and the skirt 44 as is shown in FIG. 6. At the same time, the locking flap 24 is bent downwardly into close engagement with the inner wall 42, thereby locking the hinge member 16 in place. The hinge member 16, having been firmly locked in place, firmly secures the handle 18 to the drum 10 with the handle 18 being free to pivot upwardly to carrying positions.

It will be readily apparent from the foregoing, with the exception of assembling the hinge member 16 on the cover 14, the mounting of the handles 18 involves no extra steps in the closing of the drum. At the same time, the mounting of the handles is such that they are firmly attached to the drum while being free to pivot between out-of-the-way positions and drum carrying positions.

Although only a preferred embodiment of the hinge member has been specifically illustrated and described herein, it is to be understood that minor variations may be made in the hinge member without departing from the spirit and scope of the invention as defined by the appended claims.

I claim:

1. A side handle hinge member for a fibre drum, said hinge member being in the form of a metal strip bent to define a primary leg terminating at an upper end in a reversely bent anchor portion extending to one side of said leg and forming means for engagement over a cover rim portion, a locking flap extending from said anchor portion, an offset at the lower end of said primary leg extending to the other side of said primary leg, said offset terminating in a depending leg which in turn terminates in a reverse bend; said offset, said depending leg and said reverse bend combining to define a receptacle for a cover curl and a handle pivot bar; and said reverse bend terminating in an upwardly direction anchor leg for engagement between a cover skirt and a drum wall.

2. A hinge member according to claim 1 wherein said anchor portion is curved and opens downwardly and inwardly.

3. A hinge member according to claim 1 wherein said anchor portion is curved and opens downwardly and inwardly, and said locking flap extending generally normal to said primary leg.

4. A hinge member according to claim 1 wherein said anchor portion is curved and opens downwardly and inwardly, and said locking flap extending generally normal to said primary leg and being curved to open upwardly.

5. A hinge member according to claim 1 wherein said offset is curved and opens generally downwardly for cooperation with a cover skirt curl.

6. A hinge member according to claim 5 wherein said reverse bend opens upwardly and forms a seat for a handle pivot bar.

7. A hinge member according to claim 1 wherein said reverse bend opens upwardly and forms a seat for a handle pivot bar.

8. A hinge member according to claim 1 in combination with a drum cover of the type including an end panel and an upstanding drum receiving peripheral portion including a depending outer skirt terminating in a curl, said hinge member being loosely engaged over said cover peripheral portion for application to a drum with said cover, and a handle carried by said hinge member, said handle having a pivot bar disposed in said hinge member receptacle and retained thereby.

9. A hinge member and drum cover as recited in claim 8 wherein said cover peripheral portion includes an uppermost rim, said cover skirt is telescoped between said primary leg and said anchor leg, said curl is disposed in said hinge member receptacle, and said anchor portion is engaged over said rim.

10. A hinge member according to claim 1 together with a drum of the type including a body terminating in an open upper end, and a cover telescoped over an upper end portion of said drum body and closing said drum upper end, said cover including an end panel and an upstanding peripheral portion including an upper rim and a depending peripheral skirt terminating in a curl, said upstanding peripheral portion also including an upstanding inner wall, said cover upstanding peripheral portion receiving in telescoped relation between said skirt and said inner wall an upper portion of said drum body, said hinge member being engaged over said cover with said anchor leg being positioned between said cover skirt and said drum body, said curl received in an upper part of said hinge member receptacle, said hinge member primary leg extending upwardly outside of said cover skirt with said hinge member anchor portion engaged over said rim and said locking flap extending downwardly generally into said cover and engaging said cover inner wall, said cover peripheral portion being crimped onto said drum body in locking engagement, and a handle for said drum having a pivot bar trapped in said hinge member receptacle below said curl.

* * * * *